United States Patent [19]

Arata et al.

[11] Patent Number: 5,040,958

[45] Date of Patent: Aug. 20, 1991

[54] SCROLL COMPRESSOR HAVING CHANGEABLE AXIS IN ECCENTRIC DRIVE

[75] Inventors: Tetsuya Arata; Masao Shiibayashi; Kazutaka Suefuji, all of Shimizu, Japan

[73] Assignee: Hitachi, Ltd., Tokyo, Japan

[21] Appl. No.: 335,936

[22] Filed: Apr. 10, 1989

[30] Foreign Application Priority Data

Apr. 11, 1988 [JP] Japan ..... 63-88645[U]
Apr. 22, 1988 [JP] Japan ..... 63-98144

[51] Int. Cl.[5] ..... F04C 18/04

[52] U.S. Cl. ..... 418/55.5; 418/57; 418/151

[58] Field of Search ..... 418/55.5, 57, 151

[56] References Cited

U.S. PATENT DOCUMENTS

| | | | |
|---|---|---|---|
| 3,884,599 | 5/1975 | Young et al. | 418/55.3 |
| 3,924,977 | 12/1975 | McCullough | 418/57 |
| 4,580,956 | 4/1986 | Takahashi et al. | 418/14 |
| 4,597,724 | 7/1986 | Sato et al. | 418/151 |
| 4,838,773 | 6/1989 | Noboru | 418/55 D |

FOREIGN PATENT DOCUMENTS

| | | | |
|---|---|---|---|
| 2428228 | 1/1975 | Fed. Rep. of Germany . | |
| 50-32512 | 3/1975 | Japan . | |
| 61-8403 | 1/1986 | Japan | 418/55 D |
| 61-8405 | 1/1986 | Japan | 418/57 |
| 61-215481 | 9/1986 | Japan | 418/55 D |

*Primary Examiner*—John J. Vrablik
*Attorney, Agent, or Firm*—Antonelli, Terry, Stout & Kraus

[57] ABSTRACT

A scroll compressor comprising a stationary scroll member having a stationary spiral wrap extending from a stationary end plate, an orbiting scroll member having an orbiting spiral wrap extending from an orbiting end plate with the wraps of the stationary scroll member and orbiting scroll member engaging with each other to form a fluid compressing chamber. A main shaft rotates on its own axis, with an eccentric drive shaft being provided having an axis spaced from the axis of the main shaft to orbit around the axis of main shaft and so that the eccentric drive shaft drives the orbiting scroll member to orbit around the axis of the stationary scroll member. The eccentric drive shaft is guided on the main shaft so that a distance between the axis of eccentric drive shaft and the axis of main shaft can be changed, and the main shaft drives the eccentric drive shaft to orbit around the axis of the main shaft. A balance is connected to the eccentric drive shaft, with a center of gravity of the balance weight being spaced from the axis of main shaft so that the centrifugal force of the balance weight draws the eccentric drive shaft toward the main shaft. An arrangement is provided for pushing the eccentric drive shaft away from the main shaft.

1 Claim, 10 Drawing Sheets

SCROLL COMPRESSOR HAVING CHANGEABLE AXIS IN ECCENTRIC DRIVE

BACKGROUND OF THE INVENTION

This invention relates to a scroll compressor, especially to a scroll compressor in which a clearance between scroll wraps varies in accordance with speed of revolution.

In a conventional scroll compressor as described in Japanese Unexamined Patent Publication No. 50-32512, a centrifugal force of an orbiting scroll member seals seal a radial clearance between scroll wraps, and a link mechanism or a spring force is applied in the direction opposite to the centrifugal force direction of the orbiting scroll member to reduce the sealing force to a suitable degree. In some cases, a force of compressed gas is used to seal the radial clearance between scroll wraps.

In the above mentioned art, the centrifugal force of the orbiting scroll member moves the orbiting scroll member raedially outwardly and presses the orbiting scroll member on a side wall of a stationary scroll wrap so that the radial clearance between the scroll wraps is reduced or eliminated. When the speed of orbital motion of the orbiting scroll member is increased, a contact force between the scroll wraps increases and large forces are generated on the scroll wraps, so that there are possibility of damaging and problems of increased vibration d noise generated by the contacts between the scroll wraps.

OBJECT AND SUMMARY OF THE INVENTION

An object of the present invention is to provide a scroll compressor which prevents a decrease in compressing efficiency when the orbiting scroll member orbits at a low speed, prevents an excessive contact force on the scroll wraps, reduces the generated vibration and noise, and maintain a high reliability of the scroll compressor when the orbiting scroll orbits at a high speed.

In accordance with advantageous features of the preset invention, a scroll compressor is provided which includes a stationary scroll member having a stationary end plate and a stationary spiral wrap extending from the stationary end plate, and an orbiting scroll member having an orbiting end plate and an oribiting spiral wrap extending from the orbiting end plate and which orbits around the axis of the stationary scroll member and an orbiting bearing, with the wraps of the stationary scroll member and orbiting scroll member engaging each other to form a fluid compressing chamber. an anti-rotating device prevents the orbiting scroll member from rotating on its own axis and permits the orbiting scroll member to orbit around the axis of the stationary scroll member. a main shaft rotates on its own axis, with an eccentric drive shaft being arranged at a distance from the axis of the main shaft to orbit around the axis of the main shaft and rotationally engage with the orbiting bearing. The eccentric drive shaft is guided on the main shaft so that a distance between the axis of the eccentric drive shaft and the axis of the main shaft can be changed. A balance weight is connected to the eccentric drive shaft, with a center of gravity of the balance weight being arranged at a distance spaced from the axis of the mains shaft so that the centrifugal force of the balance weight is effective upon he eccentric drive shaft with respect to the main shaft. Means are provided for pushing the eccentric drive shaft in a direction away from the main shaft.

By virtue of the above noted features of the scroll compressor of the present invention, at a high speed of revolution of the main shaft, the eccentric distance between the axis of eccentric drive shaft and the axis of main shaft, that is, the orbital radius of the orbiting scroll member is reduced by the centrifugal force of the balance weight which increases in accordance with the increase of the speed of revolution of the main shaft, so that the clearance between the scroll wraps is increased. Further, at a low speed of revolution of the main shaft, the eccentric distance between the axis of eccentric drive shaft and the axis of main shaft, that is, the orbital radius of the orbiting scroll member is increased by the means for pushing and by the centrifugal force of balance weight which decreases in accordance with the decrease of the speed of revolution of the main shaft, so that the clearance between the scroll raps is decreased. Therefore, a decrease in the compressing efficiency is prevented when the oribiting scroll member orbits at a low speed, excessive contact force on the scroll wraps is prevented the vibration and noise are, and the reliability of the scroll compressor is maintained at a high degree when the orbiting scroll member orbits at a high speed.

BRIEF DESCRIPTION OF THE DRAWINGS

FIG. 4 is a graphical illustration of a relationship between a clearance between side walls of the wraps and a clearance of a stopper pin portion in a scroll compressor.

DETAILED DESCRIPTION OF PREFERRED EMBODIMENTS

Figure 3:
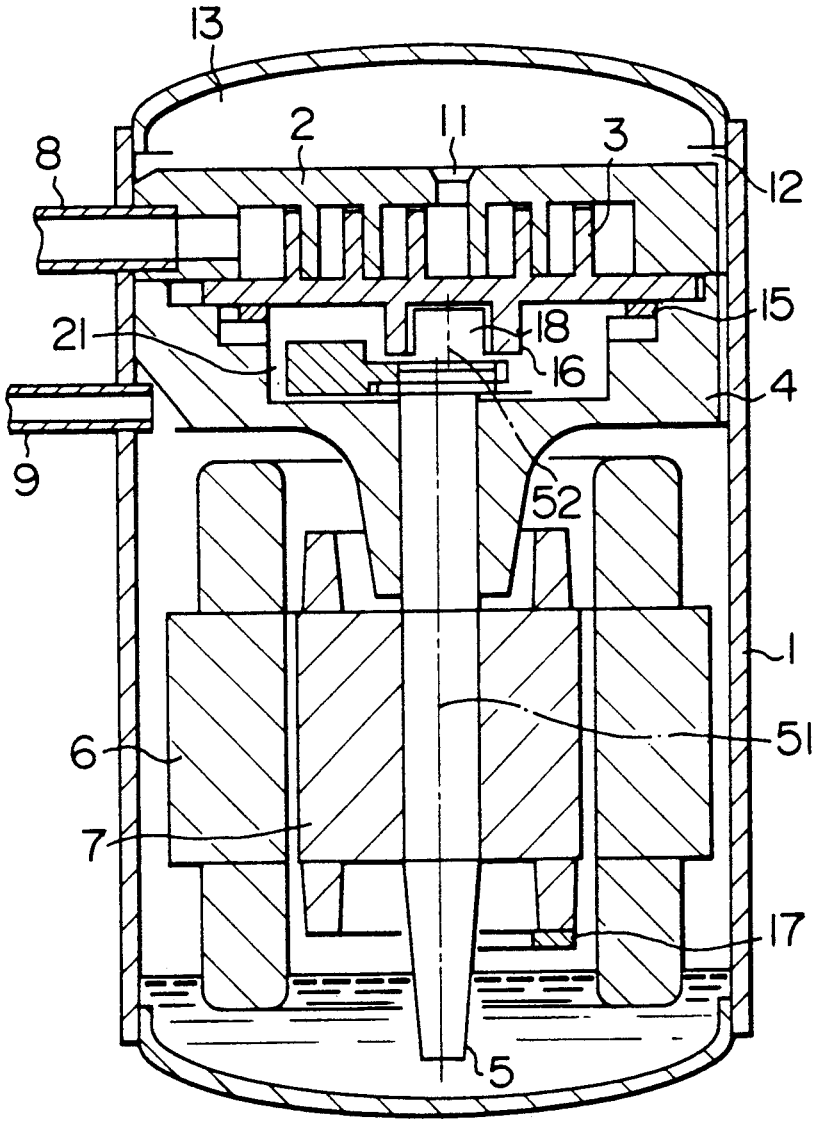
FIG. 3 is a schematic cross-sectional view of a scroll compressor of the present invention.

Referring to the drawings wherein like reference numerals are used throughout the various views to designate like parts and, more particularly, to FIG. 3, according to this figure, a scroll compressor in accordance with the present invention includes a container 1 accommodating therein a stationary scroll member 2 having a stationary spiral wrap and an orbiting scroll member 3 having an orbiting spiral wrap. The stationary scroll member 2 and the orbiting scroll member 3 face on each other to form a compressing chamber between the wraps engaging with each other. A gas is suctioned through an inlet tube 8 and flows into the compressing chamber through a peripheral portion of the orbiting scroll member 3. The orbiting scroll member 3 is prevented from rotating on its own axis by an anti-rotating mechanism 15. An eccentric drive shaft 18 is arranged on the main shaft 5 and the eccentric axis 52 of the eccentric drive shaft 18 is arranged away from the main axis 51 of the main shaft 5 so that the eccentric drive shaft 18 orbits around the main axis 51 of the main shaft 5 rotating on its own axis. The orbiting scroll member 3 is driven by the eccentric drive shaft 18 engaging with an orbiting bearing 16 arranged on the end plate of the orbiting scroll member 3 so that the orbiting scroll member 3 orbits around the stationary scroll member 2. The gas in the compressing chamber formed between the stationary and orbiting scroll wraps is transferred toward the center of the stationary scroll member 2 and is compressed gradually and flows to the outside of the scroll compressor through an outlet port 11 arranged on the center of the stationary scroll member 2, an outlet chamber 13, a passage 12 and an outlet tube 9.

The main shaft 5 is supported on a main bearing arranged on a frame 4 fixed to the stationary scroll member 2 and is rotated by a motor having a rotor 7 and a stator 6. A balance weight 21 is attached to the eccentric drive shaft 18.

Figure 1:
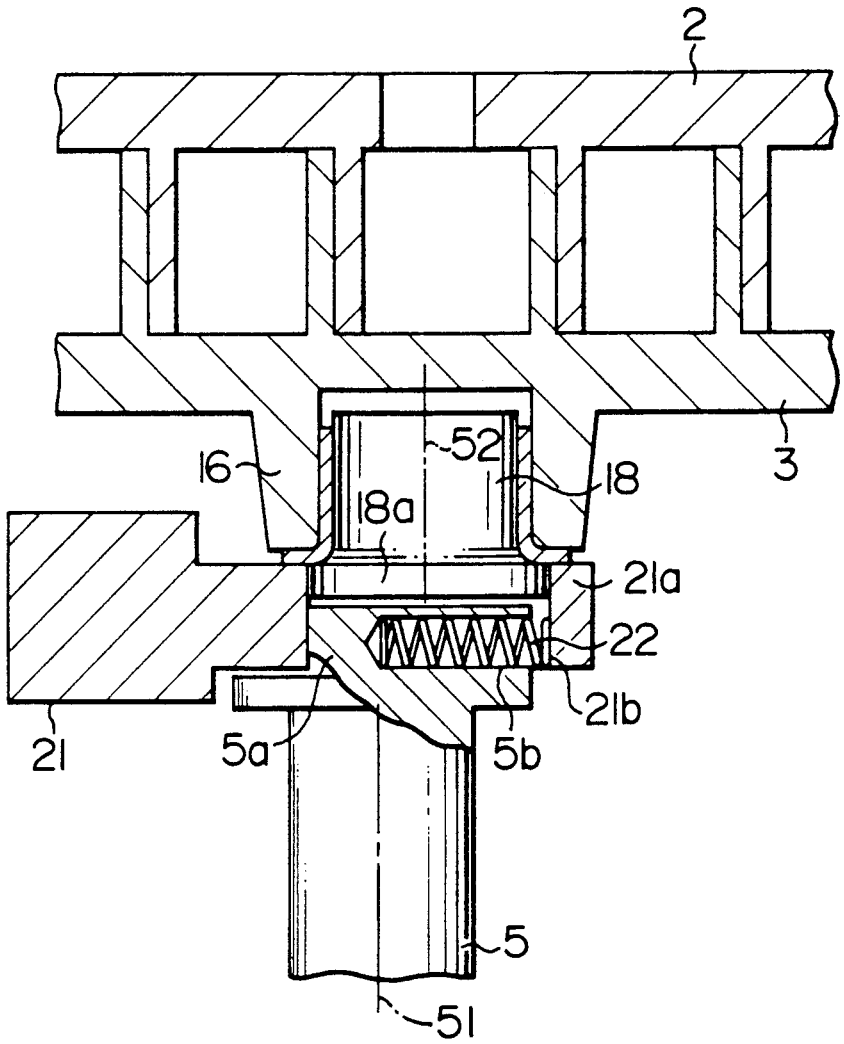
FIG. 1 is a cross-sectional view of a portion of a scroll compressor constructed in accordance with the present invention.
Figure 2:
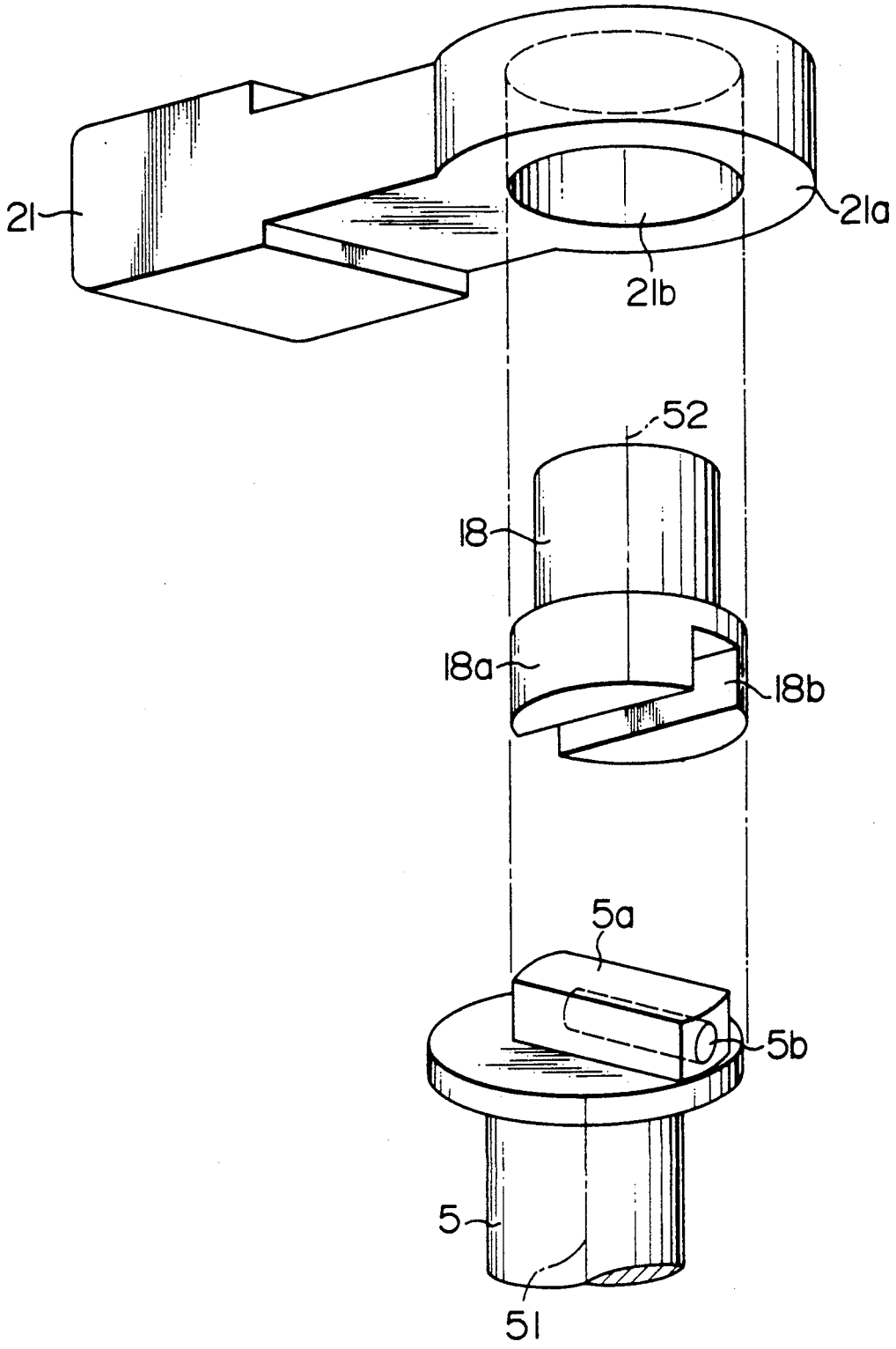
FIG. 2 is an exploded view f an assembly of a main shaft, an eccentric drive shaft and a balance weight of the scroll compressor of the present invention.

As shown in FIGS. 1 and 2, an eccentric axis 52 of the eccentric drive shaft 18 is arranged away from the main axis 51 of the main shaft 5 so that the orbiting scroll member 3 orbits around the axis of the stationary scroll member 2. An eccentric distance between the eccentric axis 52 and the main axis 51 is substantially equal to the radius of the orbital motion. In a scroll compressor of the present invention, the eccentric distance, that is, the radius of the orbital motion is slightly changed in accordance with the speed of revolution of the main shaft 5, in a manner described morefully below.

The eccentric drive shaft 18 is fitted in the orbiting bearing 16 arranged on the end plate of the orbiting scroll member 3 and has a large diameter portion 18*a* whose axis is on the eccentric axis 52 of the eccentric drive shaft 18 and which is formed integrally with the eccentric drive shaft 18. The large diameter portion 18*a* has a lateral groove 18*b* extending perpendicular to the eccentric axis 52 of the eccentric drive shaft 18. The balance weight 21 is fixed to the eccentric drive shaft 18 with a hole 21*b* of an attaching portion 21*a* thereof fitting tightly with the large diameter portion 18*a*, so that both ends of the lateral groove 18*b* of the large diameter portion 18*a* are closed with an inner surface of the hole 21*b*. The center of gravity of the balance weight 21 is arranged substantially on the axis of the lateral groove 18*b* perpendicular to the eccentric axis 52 of the eccentric drive shaft 18*a*. A guide rail 5*a* is formed at an upper end of the main shaft 5 integrally with the main shaft 5. A longitudinal axis of the guide rail 5*a* is perpendicular to the main axis 51 and a center of the guide rail 5*a* is arranged away from the main axis 51 in the radial direction of the main shaft 5. The guide rail 5*a* is fitted in the lateral groove 18*b* of the eccentric drive shaft 18 and the eccentric drive shaft 18 can slide along the guide rail 5*a*. Therefore, the axis of the eccentric drive shaft is arranged away from the axis of the main shaft. The guide rail 5*a* has a lateral blind hole 5*a* accommodating spring 22 pressing the inner surface of the hole 21*b* of the balance weight 21. A difference between the inner diameter of the hole 21*b* and the length of the guide rail 5*a* of the main shaft 5 corresponds substantially to an adjusting amount for adjusting a clearance between the scroll wraps of the stationary and orbiting scroll member.

By the above mentioned structure, the eccentric distance between the axis of the eccentric drive shaft 18 and the axis of the main shaft 5, that is, the orbital radius of the orbiting scroll member, is changed in accordance with the speed of the orbital motion of the orbiting scroll member, that is, the speed of revolution of the main shaft 5, in the manner described below. In FIG. 1, the orbiting scroll member 3 is pressed toward the stationary scroll member by a force of the spring 22 and the orbital radius is increased and the clearance between the scroll wraps of the stationary and orbiting scroll member is zero.

Figure 4:
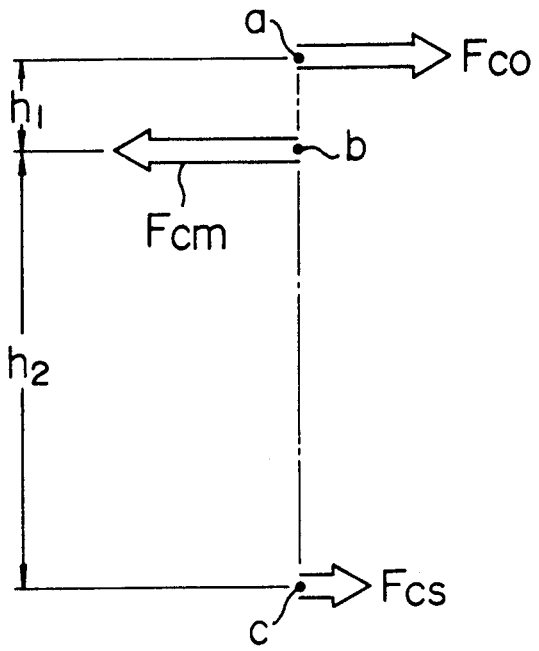
FIG. 4 is a force diagram of centrifugal forces applied to the main shaft of a scroll compressor.

A centrifugal force of the orbiting scroll member 3 orbiting around the axis of the main shaft 5 with the orbital radius is applied to the main shaft 5 through the eccentric drive shaft 18 in the direction joining the center of gravity of the orbiting scroll member 3 and the axis of the main shaft 5. Further, a centrifugal force of the eccentric drive shaft 18 is applied to the main shaft 5. A balance weight 21 and a lower balance weight 17, as shown in FIG. 3, is arranged to balance the centrifugal forces so that vibration is decreased. In FIG. 4, Fco is a centrifugal force generated by the orbiting scroll member 3 and the eccentric drive shaft 18. Fcm is a centrifugal force generated by the balance weight 21. Fcs is a centrifugal force generated by the lower balance weight 17. The points of a, b and c are respective action points of Fco, Fcm and Fcs. Distances between a and b and between b and c are denoted by h1 and h2 respectively. Following formulas are given by the balances in force and moment.

$$Fcm = Fco + Fcs \quad (1)$$

$$Fco * h1 = Fcs * h2 \quad (2)$$

$$Fcm = (1 + h1/h2) * Fco \quad (3)$$

Therefore, $$Fcm - Fco = h1 * Fco/h2 \quad (4)$$

When Mo denotes the total amount of masses of the orbiting scroll member 3 and the eccentric drive shaft 18, $\epsilon$ denotes the radius of the orbital motion and $\omega$ denotes the angular velocity of the main shaft, Fco is given by a following formula.

$$Fco = Mo*\epsilon*\omega^2 \quad (5)$$

Therefore, $$Fcm - Fco = h1*Mo*\epsilon*\omega^2/h2 \quad (6)$$

and, a relation between $\omega$ and a driving frequency Hz is given by a following formula.

$$\omega = 2*\pi*Hz \quad (7)$$

Figure 5A:
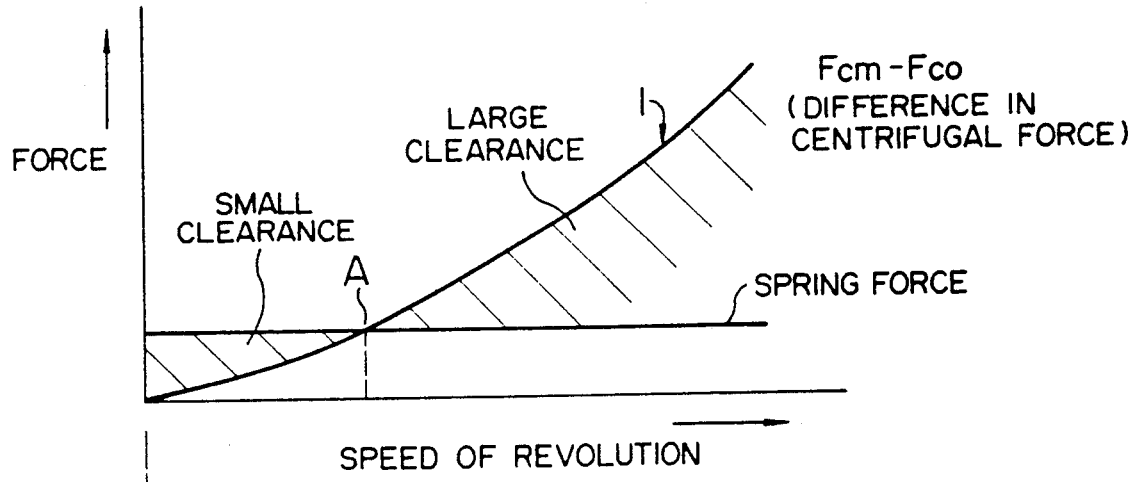
FIGS. 5*a*, 5*b* are graphical illustrations of a relationship between he speed of revolution, difference in centrifugal force, spring force, and wrap clearance in the scroll compressor incorporating the features of FIG. 1.

FIG. 5*a* provides a graphical illustration of the relationship between a difference in centrifugal force (Fcm−Fco) and the driving frequency Hz (Speed,of revolution of the main shaft 5) calculated on the basis of the formulas (6) and (7) as well as the force of spring 22 set in the guide rail 5*a* of the main shaft 5.

Figure 5B:
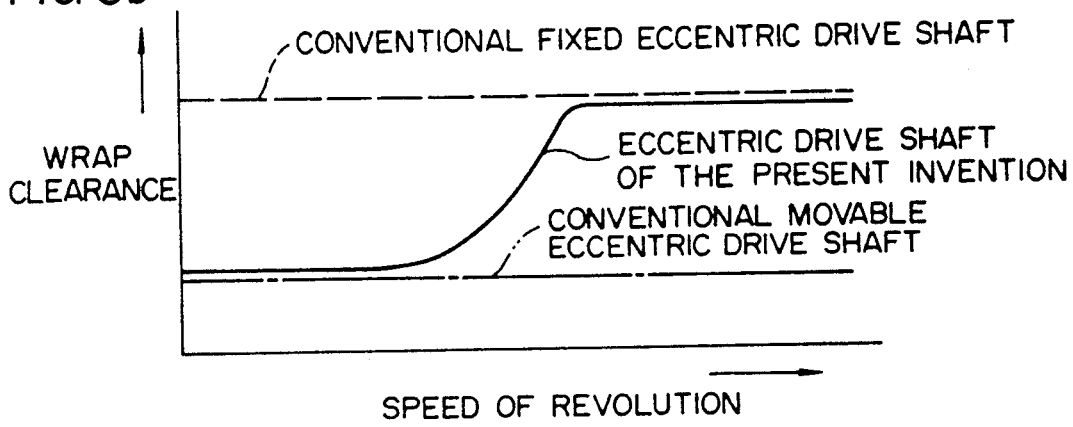

FIG. 5*b*provides a graphical illustration o f the relationship between the clearance between the wraps of the stationary and orbiting scroll members and the driving frequency Hz. When the driving frequency Hz is smaller than a balance frequency A at which the difference in centrifugal force (Fcm−Fco) is equal to the spring force, the radius of the orbital motion increases and the clearance between the wraps of the stationary and orbiting scroll members is reduced substantially to zero.

When the driving frequency Hz is larger than a balance frequency A, the radius of the orbital motion decreases and the clearance between the wraps of the stationary and orbiting scroll members is increased. When the driving frequency Hz increases further, the inner surface of the hole 21*b* contacts with the longitudinal end of the guide rail 5*a*, so that the maximum clearance between the wraps is limited to a predetermined degree.

Figure 6:
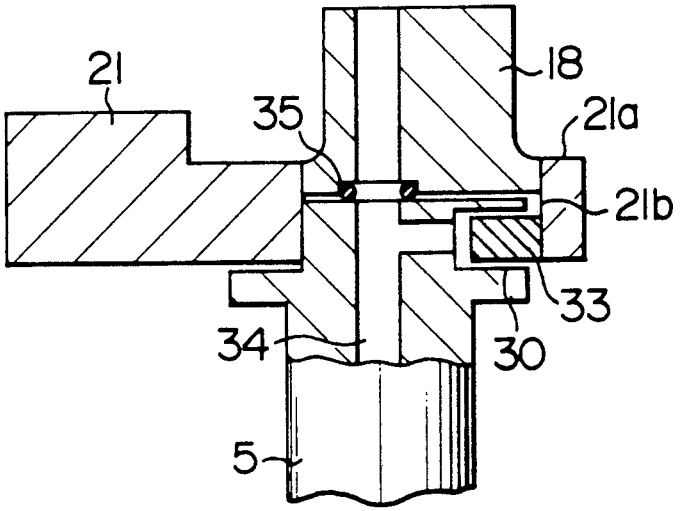
FIG. 6 is a partial cross-sectional view of a portion of another embodiment of a scroll compressor constructed in accordance invention.
Figure 7:
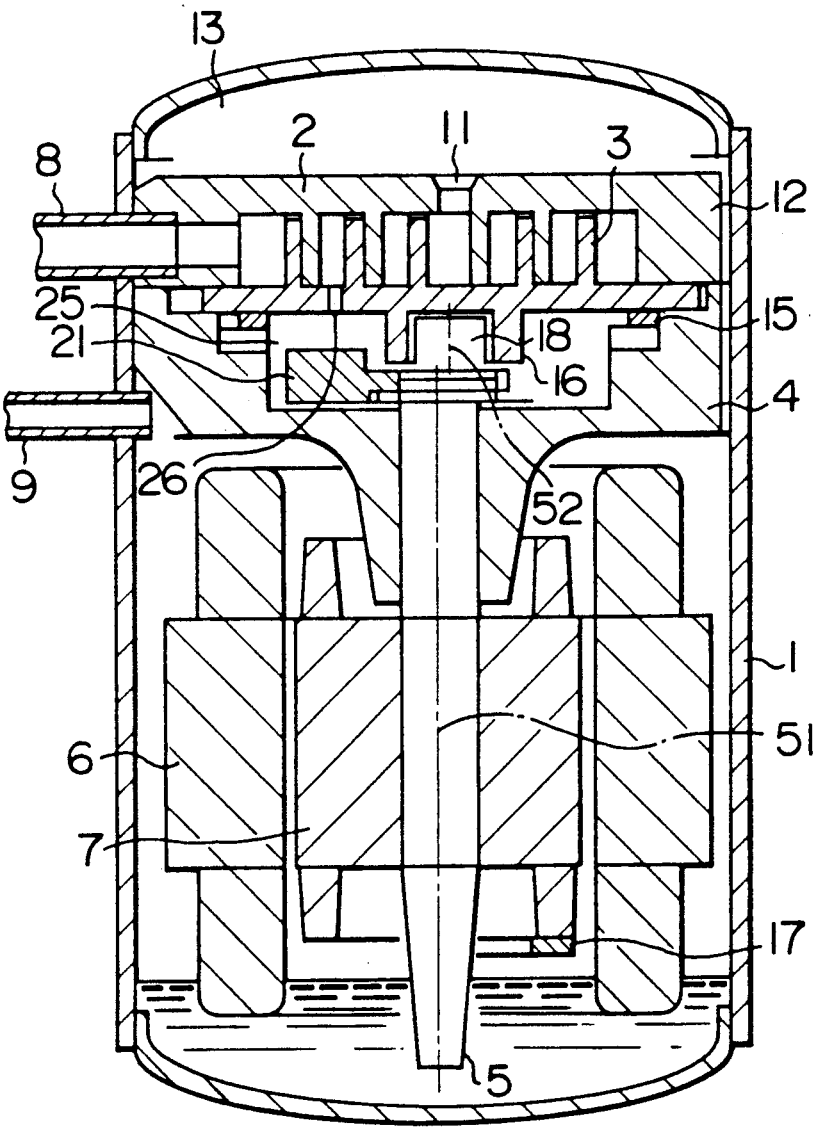
FIG. 7 is a cross-sectional view of a scroll compressor constructed in accordance with the present invention incorporating a portion thereof illustrated in FIG. 6.
Figure 8:
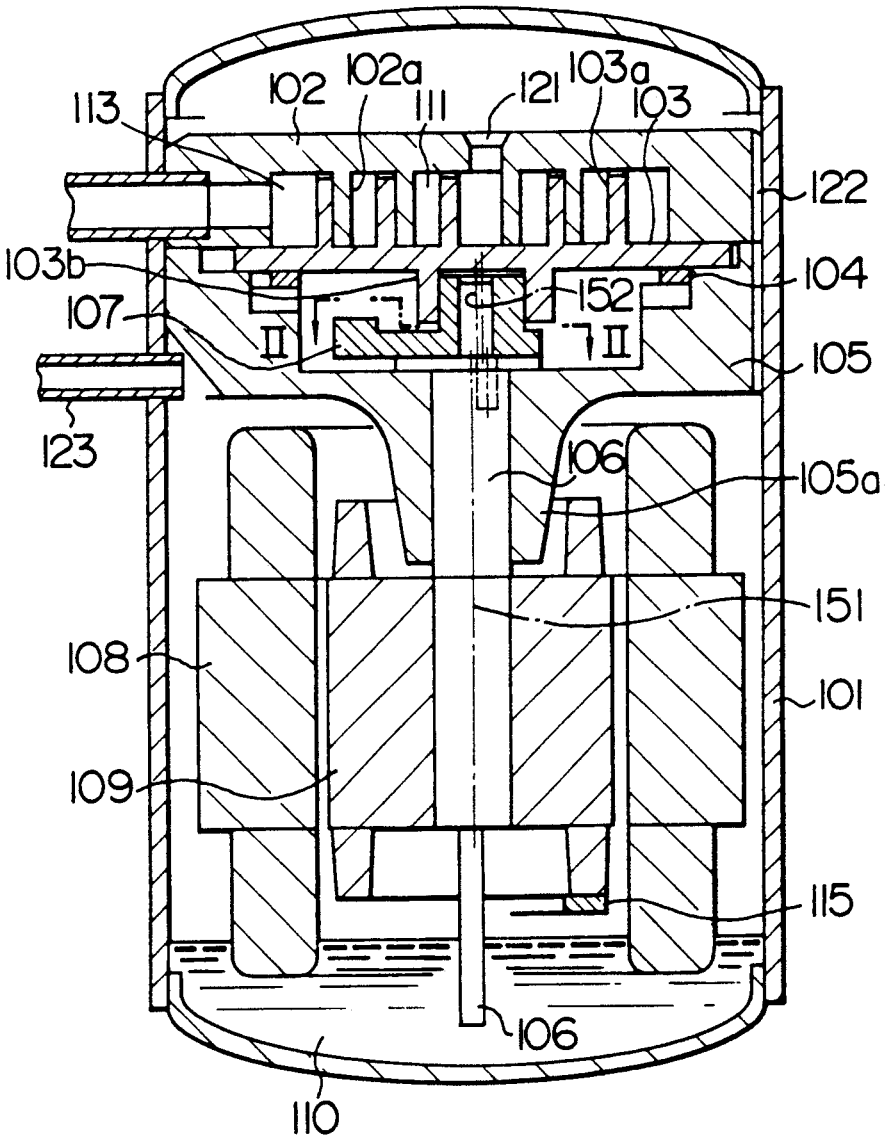
FIG. 8 is a cross-sectional view of yet another embodiment of a scroll compressor in accordance with the present invention.

In the embodiment of FIGS. 6 and 7, a piston 33 is accommodated in the lateral hole 30 of the guide rail instead of the spring 22 of the embodiment shown in FIGS. 1 and 2. A fluid pressure is applied to the piston 33 and the piston presses the inner surface of the hole 21*b* of the attaching portion 21*a* in the balance weight 21. An oil-supplying hole 34 extends to a lower chamber through the main shaft 5 and the eccentric drive shaft 18, which lower chamber is arranged at the lower end of the main shaft 5 and receives high-pressure oil, as shown in FIG. 7. And the high-pressure oil is supplied to the inner side of the piston 33 from the lower chamber through the oil-supplying hole 34. An intermediate-pressure space 25 receiving the balance weight 21 (an outside of the piston 33) is filled with a low-pressure or intermediate-pressure gas so that a difference in pressure between both ends of the piston 33 generates a force for pressing the inner surface of the hole 21*b*. The intermediate-pressure gas is supplied to the intermediate pressure space 25 through an introducing hole 26 from the compressing chamber formed between the wraps, which introducing hole 26 extends through the end plate of the orbiting scroll member 3 as shown in FIG. 3. Sealing off for the difference in pressure is effected by an O-ring 35, a clearance of the piston 33 and a bearing clearance of the orbiting scroll member.

The force of the piston 33 for pressing the inner surface of the hole 21*b* relates to the difference in pressure and to the piston areas to which the pressures are applied, and the piston areas are suitably determined so that a desired pressing force is generated by a difference in pressure. The operation of this embodiment is similar to that of the aforementioned embodiment of FIG. 1. But, since the pressing force is changed in accordance with the pressures, the operation of this embodiment is somewhat intricate in comparison with the embodiment of FIG. 1.

In the embodiment of FIGS. 8 to 15, a scroll compressor includes a compressing device comprising a stationary scroll member 102, an orbiting scroll member 103, an Oldham's coupling 104, a frame 105 and an eccentric drive device 107, a motor comprising a stator 108 and a rotor 109, and a main shaft 106 for transmitting a driving force of the motor to the compressing device. Those elements are received in a sealed container 101. A compressing chamber 111 for increasing fluid pressure from a low degree to a high degree is formed by the stationary scroll member 102 which is fixed to the frame 105 and which has a stationary end plate and a spiral stationary wrap 102*a* extending from the stationary end plate, and by the orbiting scroll member 103 which is driven by the main shaft 106 and which has an orbiting end plate and a spiral orbiting wrap 103*a* extending from the orbiting end plate. An axis of eccentric drive shaft 107*a* of eccentric drive device 107 is arranged away from the axis of the main shaft 106. The orbiting scroll member 103 is driven by the eccentric drive shaft 107*a* to orbit around the axis of the main shaft 106 with an orbital radius. And the orbiting scroll member 103 is prevented from rotating on its own axis by the Oldham's coupling 104. A low-pressure fluid flows from an inlet chamber 113 to the compressing chamber 111 and is compressed therein. Subsequently, the compressed high-pressure fluid flows into the sealed container 101 through an outlet port 121. And the high-pressure fluid flows to the outside of the sealed container 101 through an outlet passage 122, a peripheral portion of the motor and an outlet tube 123. If the scroll compressor is used in a refrigerator system, the high-pressure fluid flows to a heat exchanger (not shown). The main shaft 106 is supported in a bearing boss 105*a* of the frame 105. The orbiting scroll member 103 has an orbiting bearing boss 103*b* in which the eccentric drive shaft 107*a* is fitted to drive the orbiting scroll member 103. A lower portion of the sealed container 101 receives lubricating oil 110. The lubricating oil 110 is supplied to the bearings through a lubricating oil hole 126 extending in the main shaft 106.

Figure 9:
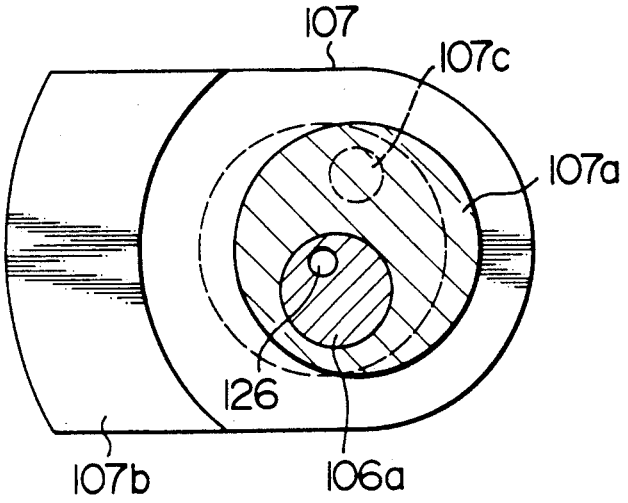
FIG. 9 is a cross-sectional view taken along the line IX—IX in FIG. 8.
Figure 10:
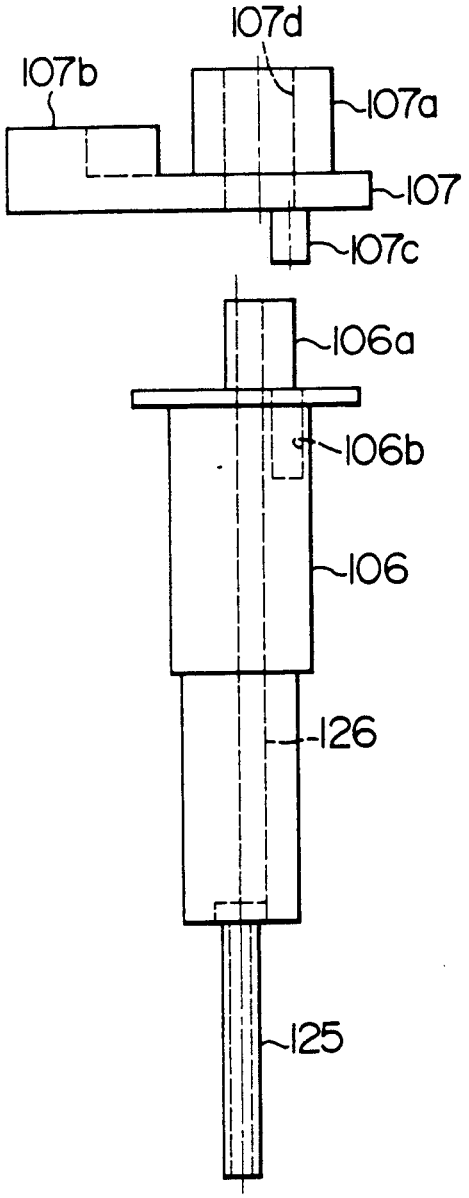
FIG. 10 is a plan view of an assembly of an eccentric drive shaft and a main shaft for a scroll compressor constructed in accordance with the present invention.

As shown in FIGS. 9 and 10, an upper portion of the main shaft 106 has a cylindrical pivot pin 106*a* whose axis is arranged away from and parallel to the axis of the main shaft 106, and has a cylindrical inserting hole 106*b*. The eccentric drive device 107 has an eccentric drive shaft 107*a*, an upper balancer 107*b*, a cylindrical stopper pin 107*c* and a cylindrical through hole 107*d*. A distance between the axis of the eccentric drive shaft 107*a* and the axis of the main shaft is substantially equal to the orbital radius. The pivot pin 106*a* of the main shaft is fitted in the through hole 107*d* of the eccentric drive device with a small clearance less than tens microns and the stopper pin 107*c* of the eccentric drive device is fitted in the inserting hole 106*b* of the main shaft with a large clearance of hundreds microns so that the driving force of the main shaft 106 is transmitted to the eccentric drive device 107 and the orbiting scroll member is driven by the eccentric drive shaft 107*a*. The eccentric drive device 107 can rotate on the axis of the pivot pin 106*a* and the rotational range of the eccentric drive device 107 is limited by the large clearance between the stopper pin 107*c* and the inserting hole 106*b*.

The rotational direction of the eccentric drive device 107 is determined by the forces applied to the eccentric drive device 107 and the position of the pivot pin 106*a*, that is, by the rotational moments on the axis of the pivot pin 106*a*. And the rotational range of the eccentric drive device 107 is determined by the large clearance between the stopper pin 107*c* and the inserting hole 106*b* and by the positional relation between the stopper pin 107*c* and the pivot pin 106*a*.

Figure 11:
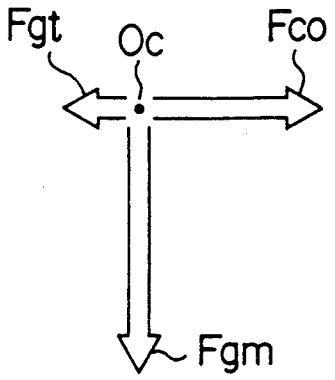
FIG. 11 is a force diagram of centrifugal forces and compressed gas forces applied to an orbiting scroll member in a scroll compressor.

When the gas is compressed, a force generated by the compressed gas is applied to the orbiting scroll member. As shown in FIG. 11, the compressed gas force is divided into a small force of Fgt in the eccentric direction joining the axes of the eccentric drive shaft 107*a* and the main shaft 106 and into a large force of Fgm in the direction perpendicular to the eccentric direction thereof. Fgt draws the orbiting scroll member toward the axis of the main shaft, and Fgm counteracts the rotation of the main shaft through the eccentric driving device. Further centrifugal forces of the orbiting scroll member, the eccentric drive shaft 107*a* and the upper balancer 107*b* are applied to the eccentric driving device. When ΔFc is a force drawing the eccentric drive shaft, Fgt is the force generated by the compressed gas in the eccentric direction, Fco is the amount of centrifugal forces of the orbiting scroll member and the eccentric drive shaft, and Fcm is a centrifugal force of the upper balancer, AFc is given by a following formula.

$$\Delta Fc = Fcm - Fco + Fgt$$

Figure 12:
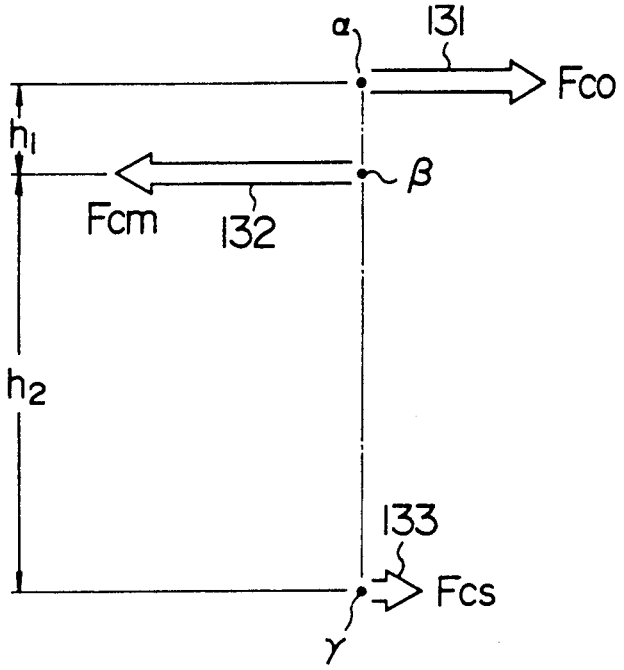
FIG. 12 ia force diagram of centrifugal forces applied to an eccentric drive shaft and main shaft in a scroll compressor.

In FIG. 12, Fcs is a centrifugal force of a lower balancer 115 arranged at a lower portion of the rotor 109. Following formulas are given on the basis of balances of force and rotational moment.

$$Fcm = Fco + Fcs$$

$$Fcm*h2 = Fco*(h1 + h2)$$

Therefore, Fcm is always greater than Fco. Usually, since Fgt is very small, ΔFc is greater than zero.

Figure 13:
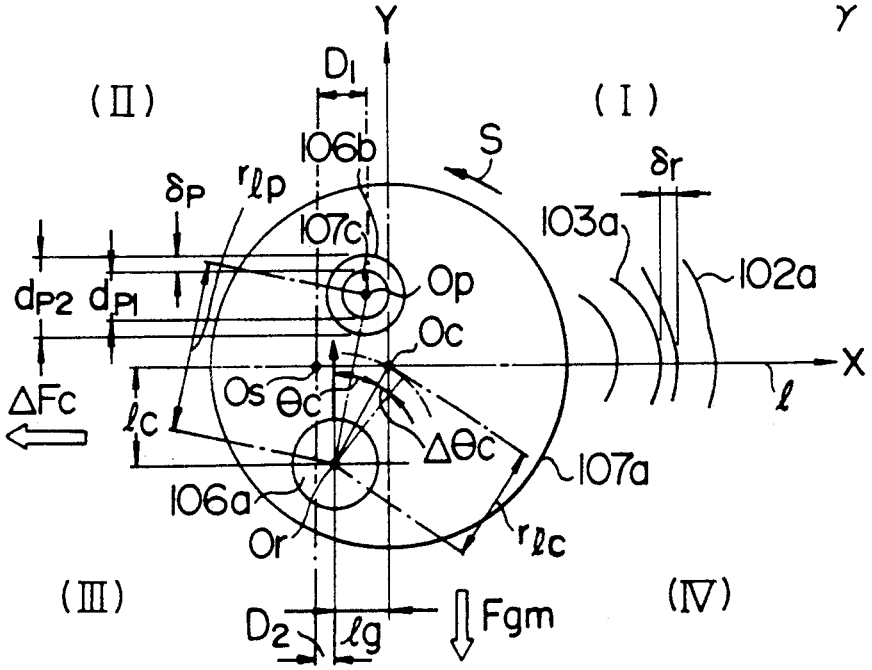
FIG. 13 is a plan view of an arrangement of a pivot pin and stopper pin in a scroll compressor constructed in accordance with the present invention.

FIG. 13 shows an arrangement of the axes of the eccentric drive shaft 107*a*, the main shaft 106 rotated in the direction of the arrow S, the pivot pin 106*a* and the stopper pin 107*c*. In FIG. 13, Oc, Os, 0r and Op denote the axes of the eccentric drive shaft 107*a*, the main shaft 106, the pivot pin 106*a* and the stopper pin 107*c*, respectively. A distance between Or and Op is denoted by rlp, a distance between Or and Oc is denoted by rlc, a distance between Or and X coordinate is denoted by lc, a distance between Or and Y coordinate is denoted by lg and a radial clearance of the stopper pin 107*c* is denoted by 6p. When ΔFc is applied to the eccentric drive shaft in the left direction on X coordinate of FIG. 13 and Fgm is applied to the eccentric drive shaft in the downward direction on Y coordinate of FIG. 13, A rotational moment ΔM of the eccentric driving device on the axis of the pivot pin 106*a* is calculated with a following formula.

$$\Delta M = \Delta Fc*1c - Fgm*1g$$

When ΔM is greater than zero, the eccentric driving device rotates counterclockwise so that the orbital radius between the axes of the main shaft and the eccentric drive shaft is decreased. When ΔM is less than zero, the eccentric driving device rotates clockwise so that the orbital radius between the axes of the main shaft and the eccentric drive shaft is increased. Therefore, the clearance between the wraps of the stationary scroll member 102 and the orbiting scroll member 103 driven by the eccentric drive shaft is changed.

The rotational angle Δκc of the eccentric drive device 107 on the axis of the pivot pin 106*a* is determined by the clearance between the stopper pi 107*c* and the inserting hole 106*b* and by the positional relationship between the stopper pin 107*c* and the pivot pin 1067*a*. Δθc is calculated by a following formula.

$$\Delta\theta c = \pm \delta p / rlp$$

When θc is an angle between Y coordinate and line rlc, and Δε is an amount of change in position of the eccentric drive shaft in the X coordinate direction, Δε is given by a following formula.

$$\Delta\epsilon = rlc* \{\sin(\theta c \pm \{\theta c) - \sin \theta c\}$$

When δro is a predetermined clearance between the wraps, and δr is an actual clearance between the wraps, δr is calculated by a following formula.

$$\delta r = \delta ro \pm \Delta\epsilon$$

$$(\delta r \geqq 0)$$

Figure 14:
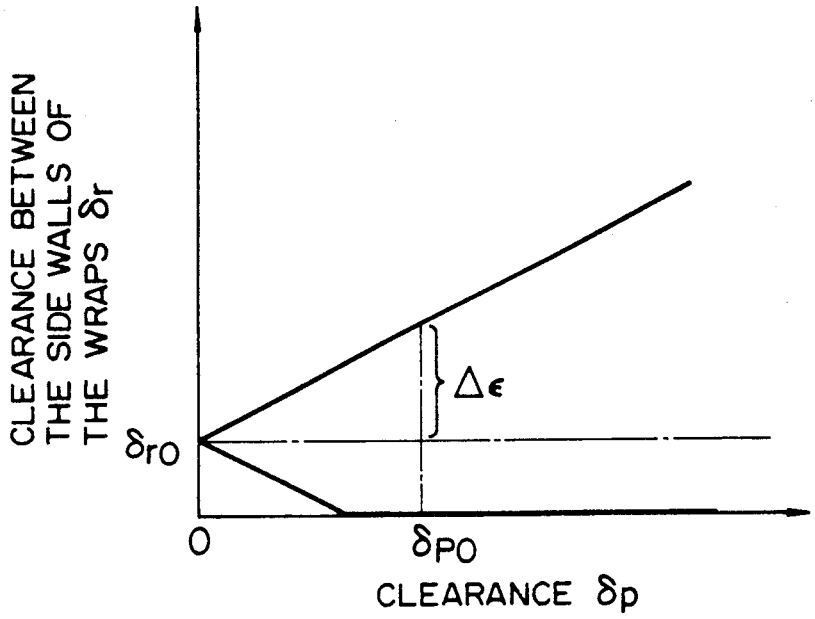

Δε is determined on the basis of δp as shown above, so that a relation between δp and δr is shown in FIG. 14.

As also shown in FIG. 13, in order to limit a range of orbital motion of the eccentric drive shaft around the axis Or of the pivot pin, a distance $D_1$ between the stopper pin or limiting means 107*c* and the axis Os of the main shaft is larger in a direction of a line l extending between the axis Os of the main shaft and the axis Oc of the eccentric drive shaft than a distance $D_2$ between the axis Os of the main shaft and the axis Or of the pivot pin.

Figure 15:
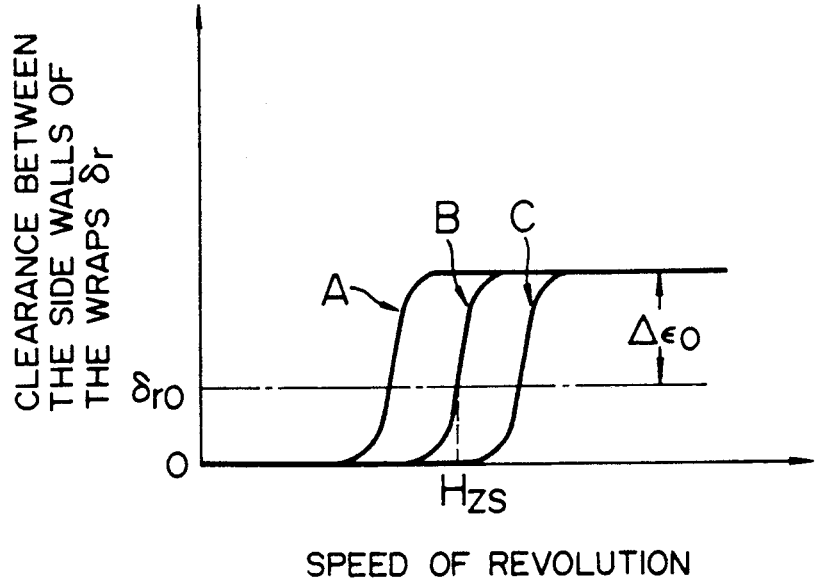
FIG. 15 is a graphical illustration of a relationship between a clearance between side walls of the wraps and speed of revolution.

As illustrated in FIG. 14, when the clearance δp between the stopper pin 107*c* and the inserting hole 106*b* is δpo, since at a high speed of revolution of the main shaft the centrifugal forces increase and ΔFc is increased, ΔM is greater than zero, so that the eccentric driving device 107 turns counterclockwise on the axis of the pivot pin 106*a* and the clearance between the wraps increases to the maximum amount of δro + Δε, as the result, the side walls of the wraps do not contact with each other, Further, since at a low sped of revolution of the main shaft the centrifugal forces decrease and ΔFc becomes small in comparison with Fgm generated by the compressed gas, ΔM is less than zero, so that the eccentric driving device 107 turns clockwise on the axis of the pivot pin 106*a* and the clearance δr between the wraps decreases to zero as shown in FIG. 15. When the load of the scroll compressor is small, the clearance δr between the wraps becomes greater than zero at a low speed of revolution of the main shaft as shown by A in FIG. 15. And when the load of the scroll compressor is large, the clearance δr between the wraps becomes more than zero at a high speed of revolution of the main shaft as shown by C in FIG. 15.

In order to effect the above mentioned operation of the eccentric driving device, the pivot pin 106*a* must be in the divisions III or I of FIG. 13, which divisions are divided with X and Y coordinates.

In the above mentioned embodiment, the clearance between the wraps changes abruptly as shown in FIG. 15. When it is necessary for the clearance between the wraps to change in proportion to the speed of revolution of the main shaft or to the pressure of the compressed gas, an elastic member may be inserted between the stopper pin 107*c* and the inserting hole 106*b*.

What is claimed is:

1. A scroll compressor comprising:

a stationary scroll member including a stationary end plate and a stationary spiral wrap extending from the stationary end plate;

an orbiting scroll member including an orbiting end plate and an orbiting spiral wrap extending from the orbiting end plate and which orbits around the axis of the stationary scroll member and has an orbiting bearing, the wraps of the stationary scroll member and the orbiting scroll member engaging with each other to form a fluid compressing chamber;

an anti-rotating device for preventing the orbiting scroll member from rotating on its own axis and for permitting the orbiting scroll member to orbit around the axis of the stationary scroll member;

a main shaft rotatable on its own axis and including a pivot pin having an axis spaced from the axis of the main shaft;

an eccentric drive shaft having an axis spaced from the axis of the main shaft and orbital around the axis of the main shaft, said eccentric drive shaft being rotationally engageable with the orbiting bearing so as to enable the eccentric drive shaft to drive the orbiting scroll member around he axis of the stationary scroll member, said eccentric drive shaft including a pivot bearing having an axis spaced from the axis of the eccentric drive shaft and rotationally engageable with the pivot pin so that the eccentric drive shaft orbits around the axis of the pivot pin, a distance between the axis of the eccentric drive shaft and the axis of the main shaft is adapted to be changed, and the main shaft drives the eccentric drive shaft to orbit around the axis of the main shaft;

a balance weight connected to the eccentric drive shaft, wherein a center of gravity of the balance weight is spaced from the axis of the main shaft, a direction of rotational moment generated on the axis of the pivot pin by a compressed gas force transmitted from the compressing chamber to the eccentric drive shaft is opposite to a direction of rotational moment generated by the centrifugal force of the balance weight on the axis of the pivot pin, the rotational moment generated by the compressed gas pushes the eccentric drive shaft away from the main shaft and pushes the eccentric drive shaft away from the pivot pin in a direction perpendicular to a direction of force applied to the axis of the eccentric derived shaft by the compressed gas, the rotational moment generated by the centrifugal force of the balance weight draws the eccentric drive shaft toward the main shaft; and limiting means for limiting a range of orbital motion of the eccentric drive shaft around the axis of the pivot pin, a distance between the limiting means and the axis of the main shaft is larger in a direction of a line extending betweent he axis of the main shaft and the axis of the eccentric drive shaft than a distance between the axis of the main shaft and the axis of the pivot pin.

* * * * *